US010918550B2

(12) United States Patent
Sherman et al.

(10) Patent No.: US 10,918,550 B2
(45) Date of Patent: Feb. 16, 2021

(54) ADJUSTABLE BED SYSTEMS WITH ROTATING ARTICULATING BED FRAME

(71) Applicants: Philip Reid Sherman, Melville, NY (US); Philip Woods McCarty, Natick, MA (US); Chuan-Hang Shih, Changhua County (TW); Horace Robert Eskridge, III, Lexington, KY (US)

(72) Inventors: Philip Reid Sherman, Melville, NY (US); Philip Woods McCarty, Natick, MA (US); Chuan-Hang Shih, Changhua County (TW); Horace Robert Eskridge, III, Lexington, KY (US)

(73) Assignee: PPJ, LLC, Natick, MA (US)

( * ) Notice: Subject to any disclaimer, the term of this patent is extended or adjusted under 35 U.S.C. 154(b) by 524 days.

(21) Appl. No.: 15/659,412

(22) Filed: Jul. 25, 2017

(65) Prior Publication Data

US 2018/0028385 A1 Feb. 1, 2018

Related U.S. Application Data

(60) Provisional application No. 62/366,920, filed on Jul. 26, 2016.

(51) Int. Cl.
*A61G 7/16* (2006.01)
*A61G 7/10* (2006.01)
(Continued)

(52) U.S. Cl.
CPC ..... *A61G 7/16* (2013.01); *A61G 7/015* (2013.01); *A61G 7/018* (2013.01); *A61G 7/1025* (2013.01); *A61G 5/14* (2013.01); *A61G 7/10* (2013.01)

(58) Field of Classification Search
CPC . A61G 7/16; A61G 7/015; A61G 7/18; A61G 7/14; A61G 7/25; A61G 7/10; A61G 5/14; A61G 13/08; A47C 17/04
See application file for complete search history.

(56) References Cited

U.S. PATENT DOCUMENTS 3,713,619 A 1/1973 Marty
3,786,523 A 1/1974 Sele
(Continued)

FOREIGN PATENT DOCUMENTS

DE 202013001182 U1 2/2013
EP 1917949 A1 5/2008
(Continued)

OTHER PUBLICATIONS

International Search Report and Written Opinion dated Oct. 3, 2017 in related International Application No. PCT/US2017/043754.
(Continued)

*Primary Examiner* — Nicholas F Polito
*Assistant Examiner* — Adam C Ortiz
(74) *Attorney, Agent, or Firm* — Patent Portfolio Builders PLLC

(57) ABSTRACT

A rotating and articulating bed includes a fixed bed frame with a horizontal support surface and an articulating bed member attached to the horizontal support surface. The articulating bed member includes an articulating head portion and a separate articulating foot portion. A rotating and pivoting frame mounted on the horizontal support surface and connect to the articulating head portion and the articulating foot portion rotates with respect to the horizontal support surface around a vertical axis passing through the horizontal support surface and provides pivoting movement of the articulating bed member with respect to the horizontal support surface to tilt the articulating bed member toward at
(Continued)

least one of the articulating head portion and the articulating foot portion.

20 Claims, 14 Drawing Sheets

(51) Int. Cl.
*A61G 7/015* (2006.01)
*A61G 7/018* (2006.01)
*A61G 5/14* (2006.01)

(56) References Cited

U.S. PATENT DOCUMENTS 3,911,509 A 10/1975 Fleckenstein
3,940,522 A 2/1976 Wessells
4,279,043 A 7/1981 Saunders
4,411,035 A 10/1983 Fenwick
4,635,894 A 1/1987 Sammons
4,934,003 A 6/1990 Hayakawa et al.
5,054,137 A 10/1991 Christensen
5,079,789 A 1/1992 Jandrakovic
5,311,622 A 5/1994 Allen
5,418,988 A 5/1995 Iura
5,497,518 A 3/1996 Iura
5,507,044 A 4/1996 Williamson et al.
5,903,935 A 5/1999 Huelke
6,155,970 A 12/2000 Dykes et al.
6,711,759 B1 3/2004 Kluckhuhn
6,880,186 B2 4/2005 Johansson
6,910,236 B2 6/2005 René
7,086,103 B2 8/2006 Barthelt
7,197,780 B2 4/2007 Petric
7,373,677 B2 5/2008 Barthelt
7,520,005 B2 4/2009 Barthelt
7,543,341 B1 6/2009 Carbaugh
7,788,748 B2 9/2010 Wurdeman
7,904,978 B2 3/2011 Wurdeman
7,979,931 B2 7/2011 Wurdeman
8,127,380 B2 3/2012 Wurdeman
8,375,489 B2 2/2013 Manouchehri
8,438,680 B2 * 5/2013 Wurdeman ..... A61G 7/00 5/611
8,495,774 B2 7/2013 Soltani
8,640,285 B2 2/2014 Heimbrock et al.
8,677,535 B2 3/2014 Turner
8,793,825 B2 8/2014 Tekulve
8,863,332 B2 * 10/2014 Rohr ..... A47C 20/041 5/617
8,887,329 B2 11/2014 Soltani
9,216,123 B2 12/2015 Tekulve
9,265,677 B2 2/2016 Manouchehri et al.
9,539,157 B2 1/2017 Liu
9,549,864 B1 * 1/2017 Tekulve ..... A61G 7/015
10,188,567 B2 1/2019 Wurdeman
2005/0102754 A1 5/2005 Barthelt
2005/0144720 A1 * 7/2005 Poulin ..... A61G 7/0507 5/425
2006/0236458 A1 10/2006 Barthelt
2007/0017029 A1 1/2007 Wurdeman
2007/0174968 A1 8/2007 Barthelt
2008/0148485 A1 6/2008 Barthelt
2009/0045311 A1 2/2009 Seyedin et al.
2010/0005591 A1 1/2010 Manouchehri
2010/0064439 A1 3/2010 Soltani
2010/0146704 A1 6/2010 Barthelt
2010/0319121 A1 12/2010 Polomsky et al.
2012/0079655 A1 4/2012 Tekulve
2012/0083396 A1 4/2012 Aquino
2012/0124746 A1 5/2012 Andrienko et al.
2013/0007960 A1 1/2013 Manouchehri et al.
2013/0042412 A1 * 2/2013 Shih ..... A47C 20/04 5/693
2013/0125310 A1 5/2013 Manouchehri
2013/0289770 A1 10/2013 Rawls-Meehan
2015/0216750 A1 * 8/2015 Miller ..... A61G 7/0507 5/662
2015/0335508 A1 11/2015 Liu
2016/0120717 A1 * 5/2016 Wurdeman ..... A61G 7/015 5/611
2017/0128295 A1 5/2017 Tekulve
2017/0208958 A1 * 7/2017 Alletto, Jr. ..... A47C 21/046
2018/0014990 A1 1/2018 Stanislao et al.
2018/0028385 A1 2/2018 Sherman et al.
2018/0369049 A1 12/2018 Eskridge, III et al.

FOREIGN PATENT DOCUMENTS

WO 2010108588 A1 9/2010
WO 2011003808 A1 1/2011

OTHER PUBLICATIONS

"The Perfect Sleep Chair," firstSTREET for Boomers and Beyond, Inc., 2018.
International Search Report in International Application No. PCT/US2019/49723 dated Nov. 19, 2019. (All references not cited herewith have been previously made of record.).
Written Opinion in International Application No. PCT/US2019/49723 dated Nov. 19, 2019. (All references not cited herewith have been previously made of record.).
"VBX Ball Bearings"; Sep. 2, 2016; 3 pages.
International Search Report in International Application No. PCT/US2019/020055 dated May 3, 2019. (All references not cited herewith have been previously made of record.).
Written Opinion in International Application No. PCT/US2019/020055 dated May 3, 2019.
Partial Supplementary European Search Report in corresponding/related European Application No. 17 835 127.6 dated May 6, 2020.
Extended European Search Report in corresponding/related European Application No. 17 835 127.6 dated Aug. 10, 2020.
Screen capture from YouTube video clip entitled "Adjustable bed that swivels the person out," uploaded on Aug. 6, 2020 by user Rotating Hospital Bed, Jun. 25, 2015, Retrieved from Internet: https://www.youtube.comiwatch? =YjU5UGgL1Ac, 1:20 clip.

* cited by examiner

ADJUSTABLE BED SYSTEMS WITH ROTATING ARTICULATING BED FRAME

CROSS-REFERENCE TO RELATED APPLICATIONS

The present application is a continuation of, and claims priority from, U.S. patent application Ser. No. 62/366,920 filed Jul. 26, 2016. The entire disclosure of that application is incorporated herein by reference.

TECHNICAL FIELD

Embodiments of the subject matter disclosed herein relate to adjustable, articulating bedding systems.

BACKGROUND

Adjustable or articulating beds provide selectable adjustment of the lower or foot portion and upper or head portion of a mattress from a traditional flat or horizontal position. Therefore, the head or foot of a user can be elevated as desired, for example, for comfort, to provide relief from snoring or to facilitate reading. The upper and lower portions are adjustable independent of each other. Adjustment is provided by an articulating foundation mounted on a frame and supporting a mattress.

The support members, hydraulic and pneumatic lifts and actuators associated with the adjustable bed are positioned underneath the sleeping surface of the adjustable bed, extending downward toward the floor. The adjustable bed sits on a frame having side rails that hide the support members, lifts and actuators. These side rails typically extend to the floor. The side rails extend to the floor and define a distance to the floor or height that is fixed. This fixed height is at least a minimum height required to accommodate placement of all the support members, hydraulic and pneumatic lifts, actuators and other electronics that provide the desired articulation in the adjustable bed.

While living room furniture and bathroom fixtures such as showers and tubs have been created to accommodate individuals with limited mobility, adjustable beds, while providing improved comfort and customization while in bed, do not provide accommodations for individuals that may have difficulty getting into and out of bed. The mattress does not rotate or tilt to assist with positioning a body in proper alignment within the adjustable bed. In addition, the location of the support members, lifts and actuators under the adjustable bed in combination with the bed frame can result in an adjustable bed that has a sleeping surface located higher above the floor, which can further inhibit the ability of an individual with limited mobility to get into and out of bed. Therefore, an adjustable bed system is desired that overcomes these limitations of conventional adjustable beds.

SUMMARY

Exemplary embodiments are directed to adjustable bed systems and methods for making and using the adjustable bed systems that accommodate individuals with limited mobility by including a pivoting mechanism that rotates the sleeping and articulating surfaces of the adjustable bed around a vertical axis passing through the adjustable bed foundation. In one embodiment, this pivoting mechanism can be adjusted to rotate in either a clockwise or counterclockwise motion. Rotation by the pivoting mechanism is accomplished in combination with the articulation of the head and foot portions of the adjustable bed foundation. Therefore, the adjustable bed foundation can be rotated while positioned between a flat, horizontal position and in a position with one or more of the head and foot portions in a raised position. In addition to rotation about the vertical axis, the pivoting mechanism can also provide tilting of the adjustable bed foundation with respect to a horizontal plane and lateral movement of the adjustable bed foundation.

Exemplary embodiments are directed to a rotating and articulating bed having a fixed bed frame with a horizontal support surface and an articulating bed member. The articulating bed member includes an articulating head portion, an articulating foot portion separate from the articulating foot portion and a rotating and pivoting frame mounted on the horizontal support surface and in communication with the articulating head portion and the articulating foot portion. The rotating and pivoting frame is rotatable with respect to the horizontal support surface around a vertical axis passing through the horizontal support surface. In addition, the rotating and pivoting frame provides pivoting movement of the articulating bed member with respect to the horizontal support surface to tilt the articulating bed member toward at least one of the articulating head portion and the articulating foot portion.

In one embodiment, the articulating head portion and articulating foot portion each articulate with respect to each other downward toward the horizontal support surface and upward away from the horizontal support surface. Articulation occurs independent of rotation of the rotating and pivoting frame and of pivoting movement of the articulating bed member with respect to the horizontal support surface. In one embodiment, the articulating foot portion articulates downward past a plane containing the horizontal support surface.

In one embodiment, the articulating bed member also includes an articulating center portion disposed between the articulating head portion and the articulating foot portion. The articulating head portion, the articulating center portion and the articulating foot portion articulate with respect to each other independent of rotation of the rotating and pivoting frame and of pivoting movement of the articulating bed member with respect to the horizontal support surface. In one embodiment, the rotating and pivoting frame is pivotally connected to the articulating center to achieve pivoting movement of the articulating bed member with respect to the horizontal support surface.

In one embodiment, the rotating and pivoting frame provides pivoting movement of the articulating bed member with respect to the horizontal support surface to tilt the articulating bed member toward the articulating foot portion from a first position with the articulating foot portion located above the horizontal support surface to a second position with the articulating foot portion extending below the horizontal support surface. In one embodiment, the horizontal support surface is located at a given height, and the articulating foot portion extends below the horizontal support surface a distance greater than or equal to the given height when the articulating bed member is in the second position.

In one embodiment, the rotating and pivoting frame is rotatable around the vertical axis through an angle up to about 90°. In one embodiment, the rotating and pivoting frame is rotatable around the vertical axis in a first direction of rotation through an angle up to about 90° and in a second direction of rotation through an angle up to about 90°. The first direction of rotation is opposite the second direction of rotation. In one embodiment, the rotating and pivoting frame is rotatable around the vertical axis through an angle up to about 360°.

In one embodiment, the articulating bed member includes an articulating center portion disposed between the articulating head portion and the articulating foot portion and a pair of opposing sides extending from the articulating head portion, through the articulating center portion to the articulating foot portion. The articulating center portion has a top surface and a bottom surface opposite the top surface. The rotating and articulating bed further includes a pair of arm assemblies. Each arm assembly is attached to one of the opposing sides and includes an attachment frame connected to the bottom surface of the articulating center portion and an arm connected to the attachment frame at a pivot point and rotatable with respect to the attachment frame around the pivot point. In one embodiment, each arm assembly includes a locking mechanism disposed between the arm and the attachment frame to prevent rotation of the arm with respect to the attachment frame. In one embodiment, the attachment frame is removably connected to the bottom surface of the articulating center portion or the arm is removably connected to the attachment frame.

In one embodiment, the articulating bed member includes an articulating head portion frame, an articulating foot portion frame, an articulating center portion disposed between the articulating head portion the articulating foot portion and containing an articulating center portion frame and at least one mattress removably attached to the articulating head portion frame, articulating center portion frame and articulating foot portion frame. In one embodiment, the articulating bed member includes a plurality of mattresses. Each mattress is removably attached to one of the articulating head portion frame, articulating center portion frame and articulating foot portion frame. In one embodiment, the mattress includes at least one first part of a two-part mechanical fastener and at least one of the articulating head portion frame, articulating center portion frame and articulating foot portion frame includes at least one second part of the two-part mechanical fastener. In one embodiment, the two-part mechanical fastener is a zipper, a hook and loop type fastener, a snap, a pin type fastener, a hook and eye type fastener, a button, a magnetic fastener, a buckle and strap, a clamp, a clasp or combinations thereof.

In one embodiment, the articulating bed member includes a mattress disposed on at least one of the articulating head portion and the articulating foot portion and a mattress topper removably attached to the mattress. In one embodiment, the rotating and pivoting frame further provides lateral movement of the articulating bed member along a plane parallel to and spaced from the horizontal support surface to move the articulating bed member toward the articulating head portion or the articulating foot portion.

Exemplary embodiments are also directed to a rotating and articulating bed having a fixed bed frame with a horizontal support surface and an articulating bed member. The articulating bed member includes an articulating head portion with an articulating head portion frame, an articulating foot portion separate from the articulating foot portion and containing an articulating foot portion frame and an articulating center portion disposed between the articulating head portion and the articulating foot portion and containing an articulating center portion frame. The articulating head portion and articulating foot portion each articulate or pivot with respect to the articulating center portion downward toward the horizontal support surface and upward away from the horizontal support surface. A rotating and pivoting frame is mounted on the horizontal support surface and pivotally connected to the articulating center. The rotating and pivoting frame is rotatable with respect to the horizontal support surface around a vertical axis passing through the horizontal support surface. In addition, the rotating and pivoting frame provides pivoting movement of the articulating center portion with respect to the horizontal support surface to tilt the articulating bed member toward at least one of the articulating head portion and the articulating foot portion. At least one mattress is removably attached to the articulating head portion frame, articulating center portion frame and articulating foot portion frame.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

Figure 1:
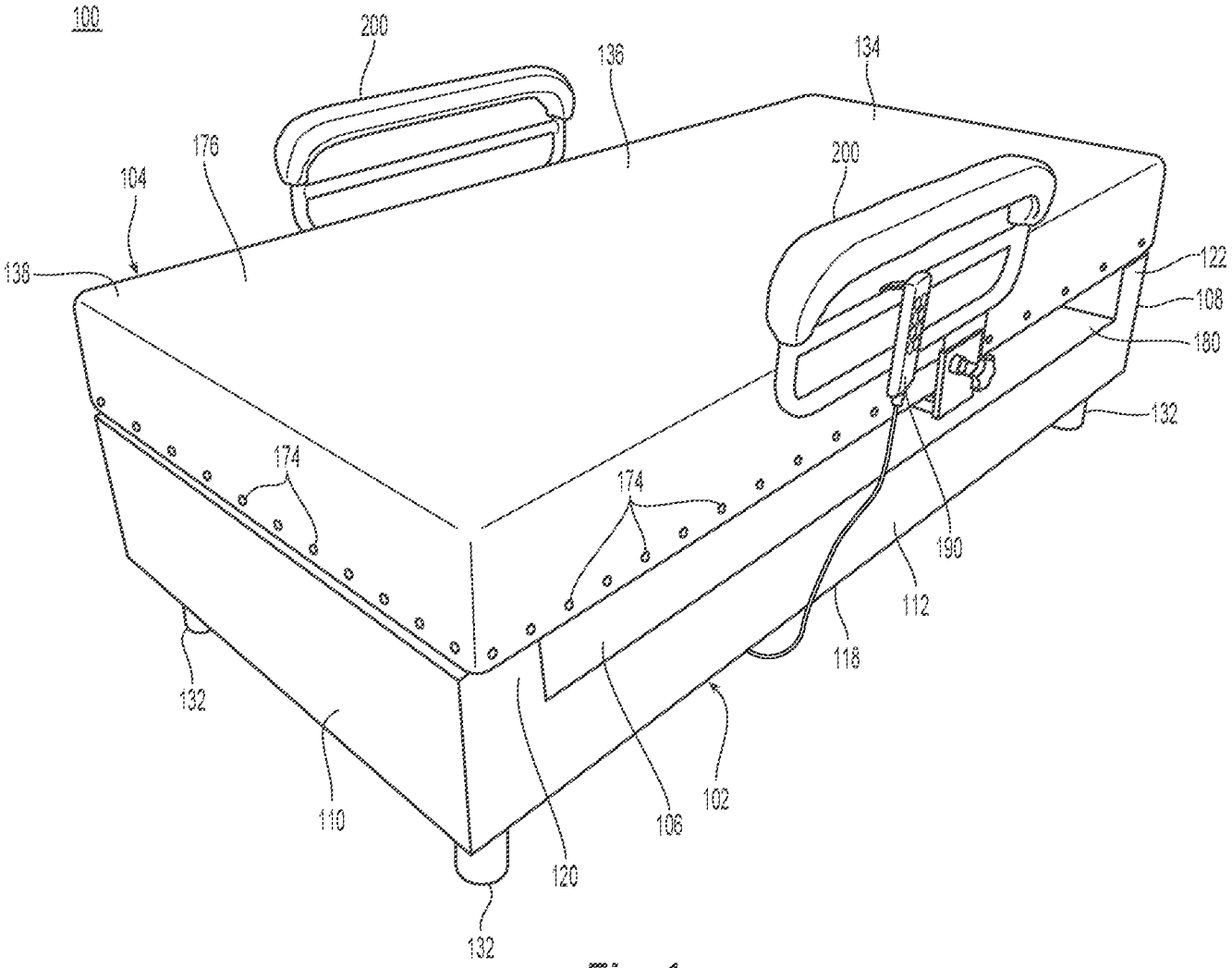
FIG. 1 is a top perspective view of an embodiment of a rotating and articulating bed in a flat position.
Figure 2:
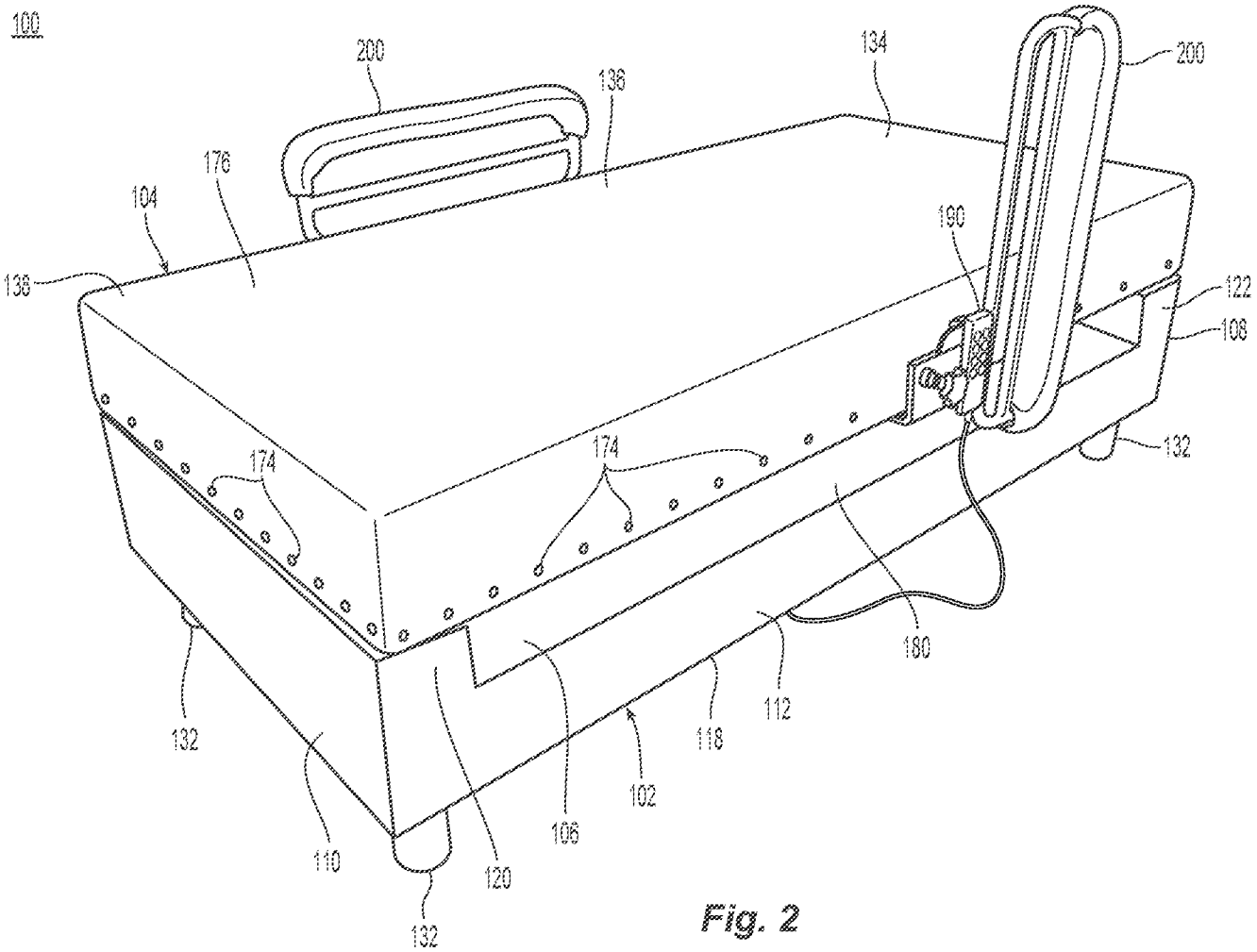
FIG. 2 is a is a top perspective view of an embodiment of a rotating and articulating bed in a flat position with an arm assembly raised.

The following description of the embodiments refers to the accompanying drawings. The same reference numbers in different drawings identify the same or similar elements. The following detailed description does not limit the invention. Instead, the scope of the invention is defined by the appended claims.

Reference throughout the specification to "one embodiment" or "an embodiment" means that a given feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the features, structures or characteristics may be combined in any suitable manner in one or more embodiments.

Exemplary embodiments are directed to a rotating and articulating bed. The rotating and articulating bed includes a first, outer, fixed bed frame having a horizontal support surface spaced from the floor and extending between the head end and the foot end of the fixed bed frame. In one embodiment, the rotating and articulating bed includes a head board attached to the head end of the fixed bed frame and a foot board attached to the foot end of the fixed bed frame opposite the head end. In one embodiment, at least one of the head board and foot board extends above the horizontal support surface. The horizontal support surface extends from the head end to the foot end of the fixed bed frame. In addition, the horizontal support surface extends from side to side of the fixed bed frame.

In one embodiment, the fixed bed frame has a base surface opposite the horizontal support surface. The fixed bed frame has a thickness between the based surface and the horizontal support surface. In one embodiment, the base surface is configured to rest directly on the floor. The thickness of the fixed bed frame defines a given height of the horizontal support surface from the floor when the base surface is in contact with the floor. In another embodiment, the fixed bed frame includes a plurality of legs extending down from the base surface. The legs are in contact with the floor and space the base surface from the floor. In another embodiment, the fixed bed frame is attached to and supported by a wheeled, elevating frame having a plurality of wheels. The wheeled elevating frame extends past the base surface and contains the framing members, motors, electronics and controls to selectively position the fixed bed frame in either an elevated position or a lowered position. The base surface of fixed bed frame in the lowered position is located at a height above the floor of about the height of the wheels.

The rotating and articulating bed also includes an articulating bed member disposed on top of or above the horizontal support surface. The articulating bed member includes the framing members, supports, motors, actuators, power sources, control electronics, switches and remotes to provide the desired rotation, articulating, pivoting and sliding of the articulating bed member with respect to the horizontal support surface. The articulating bed member includes an articulating head portion and an articulating foot portion separate from the articulating head portion. The articulating head portion articulates with respect to the articulating foot portion. The articulating bed member includes an articulating center or seat portion disposed between and in contact with the articulating head portion and the articulating foot portion. The articulating head portion and the articulating foot portion articulate with respect to the articulating center portion independent of each other. In addition, the head and foot portions also rest on the base frame member for positional stop in the flat position.

In one embodiment, the articulating bed member includes at least one mattress disposed on and covering the articulating head portion, the articulating center portion and the articulating foot portion. In one embodiment, the articulating head portion includes an articulating head portion frame, and the articulating foot portion includes an articulating foot portion frame. In addition, the articulating center portion includes an articulating center portion frame. The articulating head portion frame, the articulating center portion frame and the articulating foot portion frame articulate with respect to each other. The at least one mattress is attached to at least one of the articulating head portion frame, the articulating center portion frame and the articulating foot portion frame. In one embodiment, the articulating bed member includes three separate mattresses or mattress sections, each separate mattress is attached to one of the articulating head portion frame, the articulating center portion frame and the articulating foot portion frame. In one embodiment, the mattress is releasably attached to at least one of the articulating head portion frame, the articulating center portion frame and the articulating foot portion frame. In one embodiment, the articulating bed member includes at least one mattress topper or mattress pad releasably attached to the mattress.

In one embodiment, the articulating bed member includes a rotating and pivoting frame mounted on the horizontal support surface and in contact with at least one of the articulating head portion, the articulating foot portion and the articulating center portion. In one embodiment, the rotating and pivoting frame is mounted to the horizontal support surface. In one embodiment, framing members, supports, motors, actuators, control electronics, power sources and switches are disposed among the articulating head portion, the articulating foot portion, the articulating center portion and the rotating and pivoting frame to provide the desired articulation for the articulating head portion, the articulating foot portion and the articulating center portion. In one embodiment, the framing members, supports, motors, actuators, control electronics, power sources and switches are disposed between the rotating and pivoting frame and at least one of the articulating head portion, the articulating foot portion and the articulating center portion.

The framing members, supports, motors, actuators, control electronics, power sources and switches also provide for the rotation, pivoting and sliding movement of the articulating bed member with respect to the fixed frame and the horizontal support surface. In one embodiment, the articulating bed member, and in particular the rotating and pivoting frame, rotates with respect to the horizontal support surface in a plane parallel to the horizontal support surface. The articulating bed member rotates around a vertical axis perpendicular to and passing through the horizontal support surface. The articulating bed member rotates around the vertical access through an angle up to 360°.

In addition to rotation in a plane parallel to the horizontal support surface, the articulating bed member pivots with respect to the plane in which it rotates and, therefore, with respect to the horizontal support surface. Pivoting the articulating bed member tilts the articulating bed member forward, i.e., towards the articulating foot portion, or backwards, i.e., toward the articulating head portion. In one embodiment, pivoting motion is provide between the rotating and pivoting frame and the articulating center portion. In one embodiment, in addition to rotational and pivoting movement of the articulating bed member, sliding or lateral movement of the articulating bed member along the plane parallel to the horizontal support surface is provided. In one embodiment, the rotating and pivoting frame provides for lateral or sliding movement along the plane parallel to the horizontal support surface. Lateral or sliding movement occurs in at least one of a direction from side to side of the articulating head portion, the articulating foot portion and the articulating center portion and a direction along a line passing through the articulating bed member from the articulating head portion through the articulating center portion to the foot portion.

In one embodiment, the rotating and articulating bed includes a set or pair of arms. In one embodiment, each arm in the set of arms is located on a side of the articulating bed member and in particular on one side of the articulating head portion, the articulating foot portion or the articulating center portion. Preferably, each arm is located on one side of the articulating center section. In one embodiment, each arm is attached to the side of the articulating center section. Preferably, each arm is attached to the bottom surface of the articulating center section. Attachment to the bottom surface facilitates the use of a removable mattress and the attachment of mattress toppers and sheets to the mattress. In one embodiment, each arm is removable. In one embodiment, each arm is moveable from a first down position with the arm generally parallel to the top surface of the articulating center portion and a second up position with the arm at an angle with respect to the top surface of the articulating center portion. In one embodiment, each arm pivots to move between the first down position and the second up position. In one embodiment, each arm is lockable in at least one of the first down position and the second up position.

The rotating, articulating, pivoting and sliding movement of the articulating bed member, and if included height adjustment of the fixed bed frame, provide access to and use of the rotating and articulating bed by persons with limited mobility. The articulating bed member can be selectively positioned in a variety of arrangements between a horizontal position and a rotated and pivoted position. In the horizontal position, the articulating head portion, the articulating foot portion and the articulating center portion are flat and parallel with the horizontal support surface, and the articulating head portion and the articulating foot portion are aligned with the head end and foot end respectively of the fixed bed frame. In the rotated and pivoted position, the articulating bed member is rotated 90° with respect to the fixed bed frame and articulated and pivoted such that the articulating head portion, the articulating foot portion and the articulating center portion are arranged as a seating position with the articulating foot portion extending over the side of the fixed bed frame and all the way to the surface on which the base surface of the fixed bed frame rests.

In one embodiment, the fixed bed frame includes a head end support and a foot end support to provide support to the articulating head portion and the articulating foot portion in the horizontal position. One or more notches can be provided in the articulating head portion and the articulating foot portion to engage the head end support and the fort end support. From the horizontal position, the articulating head portion, the articulating foot portion and the articulating center portion can be adjusted as in a typical adjustable bed.

In one embodiment, to facilitate a person with limited mobility getting out of the bed, the articulating center portion is rotated with respect to the horizontal support surface with the head portion, foot portion and center portion positioned in accordance with a sitting or reclining position. The articulating bed member continues to rotate while the articulating foot portion is lowered past the plane of the horizontal support surface. At the same time, the articulating bed member is pivoted forward and can also be moved laterally so that the foot portion extends off the side of the horizontal support surface and extends towards the floor. This movement continues, until the articulating bed member has rotated about 90° and the head portion, center portion and foot portion of the articulating bed member are articulated, pivoted and slid to form a chair reaching to the ground and facing the side of the bed. Reversing these steps provides for a person with limited mobility to get into the articulating bed.

Referring now to FIGS. 1-10, an exemplary embodiment of a rotating and articulating bed 100 is illustrated. The rotating and articulating bed includes a fixed bed frame 102 and an articulating bed member 104 mounted on the fixed bed frame. The articulating bed member is mounted on the fixed bed frame to provide rotating, articulating, pivoting and sliding movement of the articulating bed member with respect to the fixed bed frame. Suitable sizes for the rotating and articulating bed including the fixed bed frame and the articulating bed member including twin, full, queen, king and California king.

The fixed bed frame is constructed from framing materials that include wood, metal, composite and plastic framing materials. In addition, the fixed bed frame is covered with upholstery and padding. The fixed bed frame has a head end 108, a foot end 110 opposite the head end and a pair of opposing sides 112 extending from the head end to the foot end. The fixed bed frame has a fixed frame length 114 from the head end to the foot end and a fixed frame width 116 between the pair of opposing sides.

The fixed bed frame includes a horizontal support surface 106 and a base surface 118 opposite the horizontal support surface. In one embodiment, the horizontal support surface extends the entire fixed frame length and the entire fixed frame width. In one embodiment, the fixed bed frame includes a head end support 122 extending up from the horizontal support surface and in from the head end and a foot end support 120 extending up from the horizontal support surface and in from the foot end. In one embodiment, the head end support and the foot end support extend the entire fixed frame width. The horizontal support surface extends from the foot end support to the head end support. The head end support and the foot end support have a support height 124 up from the horizontal support surface. The support height is selected to be sufficient to accommodate framing and operational elements located between the fixed frame and the articulating bed member.

In one embodiment, the horizontal support surface is spaced from the base surface a given distance 126. This given distance is the height of the horizontal support surface from the floor when the base surface is placed in contact with the floor. The given distance and the support height define the overall thickness 128 of the fixed frame. In one embodiment, the fixed from includes a plurality of support legs 132 (FIGS. 1-9) extending down from the base surface. For example, the fixed frame includes four support legs, one support leg adjacent each corner of the fixed frame. In one embodiment, the legs are removable. In one embodiment, the legs are extensible. When the fixed frame includes legs, the height of the horizontal support surface is the overall thickness plus the length of the support legs. In one embodiment, the fixed frame includes a plurality of wheels or rollers at the base surface. Suitable arrangements for wheels and rollers are known and available in the art.

The articulating bed member 104 includes an articulating head portion 134 and a separate articulating foot portion 138. The articulating head portion and articulating foot portion articulate with respect to each other downward toward the horizontal support surface in the direction of arrow B and upward away from the horizontal support surface in the direction of arrow A. Upward and downward articulation provides for movement and positioning of the articulating head portion and articulating foot portion from a flat position illustrated in FIGS. 1, 2 and 10, and various articulated positions illustrated in FIGS. 3-9. In one embodiment, the articulating foot portion articulates downward past a plane 130 (FIG. 10) containing the horizontal support surface (FIG. 7). Articulation of the articulating head portion and the articulating foot portion is conducted independent of other adjustments and movements of the articulating bed member including rotation, pivoting and sliding movement of the articulating bed member with respect to the fixed bed frame and the horizontal support surface.

In one embodiment, the articulating bed member includes an articulating center portion 136 disposed between and in communication with the articulating head portion and the articulating foot portion. The articulating head portion and the articulating foot portion articulate with respect articulating center portion. Articulation of the articulating head portion, the articulating center portion and the articulating foot portion with respect to each other occurs independent of rotational, pivoting and sliding movement of the articulating bed member with respect to the fixed frame. The articulating head portion, articulating center portion and articulating foot portion span the fixed frame length 114 from the head end to the foot end and the fixed frame width 116 between the pair of opposing sides.

In one embodiment, the articulating bed member includes at least one articulating head portion frame 150 disposed in the articulating head portion and at least one articulating foot portion frame disposed in the articulating foot portion. In one embodiment, the articulating bed member includes a first articulating foot portion frame 158 and a second articulating foot portion frame 160 pivotally attached to the first articulating foot portion frame. The first and second articulating foot portion frames provide for separate positioning of the upper leg and lower leg portions of the articulating foot portion. The articulating bed member includes at least one articulating center portion frame 154 disposed between the articulating head portion frame and the articulating foot portion frame, e.g., the first articulating foot portion frame 158.

The articulating center portion frame is pivotally connected to the articulating head portion frame and the articulating foot portion frame. A first actuator assembly 152, i.e., the head portion actuator, is provided between the articulating center portion frame and the articulating heat portion frame. A second actuator assembly 156, i.e., the foot portion actuator, is provided between the articulating center portion frame and the articulating foot portion frame. The actuator assemblies include the actuators, motors, push rods and frame members to provide the desired articulation among the articulating head portion, the articulation center portion and the articulating foot portion.

The articulating head portion, the articulating center portion and the articulating foot portion includes a top surface 140 and a bottom surface 142 opposite the top surface. The articulating head portion, the articulating center portion and the articulating foot portion can be set in a flat, i.e., unarticulated position, with the articulating head portion aligned with the head end of the fixed frame and the articulating foot portion aligned with the foot end of the fixed frame (FIG. 1). The bottom surface at the articulating head portion is aligned over the head end support 122, and the bottom surface at the articulating foot portion is aligned over the foot end support 120. In one embodiment, the bottom surface is in contact with at least one of the head end support and the foot end support. This arrangement defines a space or cavity 180 between the bottom surface and the horizontal support surface that extends from the head end support to the foot end support.

The articulating bed member 104 also includes at least one mattress 176 attached to the articulating head portion frame, articulating center portion frame and articulating foot portion frame. In another embodiment, the articulating bed member includes a plurality of mattresses or mattress sections. Each one of the plurality of mattresses is attached to one of the articulating head portion frame, articulating center portion frame and articulating foot portion frame. In one embodiment, the mattress is not removable from the articulating bed member. In one embodiment, one or more of the articulating head portion frame, articulating center portion frame and articulating foot portion frame is integrated into the mattress. Preferably, the mattress is removably attached to the articulating head portion frame, articulating center portion frame and articulating foot portion frame. Removeable attachment of the mattress is provided by at least one or a plurality of two-part mechanical fasteners 174 disposed between the mattress and each one of the articulating head portion frame, articulating center portion frame and articulating foot portion frame. Suitable two-part mechanical fasteners include, but are not limited to, a zipper, a hook and loop type fastener, a snap, a pin type fastener, a hook and eye type fastener, a button, a magnetic fastener, a buckle and strap, a clamp, a clasp and combinations thereof.

In one embodiment, the mattress, or each one of the plurality of mattresses, includes at least one first part of a two-part mechanical fastener. In addition, at least one of the articulating head portion frame, articulating center portion frame and articulating foot portion frame includes at least one second part of the two-part mechanical fastener. The first and second parts of the two-part mechanical fasteners can be located between the bottom surface of the mattress and the top surface of the articulating head portion frame, articulating center portion frame and articulating foot portion frame. Therefore, the two-part mechanical fastener can be hidden from view. In another embodiment, the two-part mechanical fastener is located between a fabric skirt or side of the mattress and the sides of the articulating head portion frame, articulating center portion frame and articulating foot portion frame.

In one embodiment, a plurality of first parts of a mechanical fasteners, i.e., a plurality of first parts of snaps or hook and loop type fasteners, are attached along a bottom skirt area of the mattress or fabric border extending down from the bottom of the mattress, and a corresponding plurality of second parts of the mechanical fasteners are attached to the sides of one or more of the articulating head portion frame, articulating center portion frame and articulating foot portion frame. Therefore, the mattress is placed on top of the articulating head portion frame, articulating center portion frame and articulating foot portion frame with the fabric skirt extending over the sides, and the first and second parts of the two-part mechanical fasteners are aligned. Once aligned, the first and second parts of the two-part mechanical fasteners are connected, securing the mattress to the articulating head portion frame, articulating center portion frame and articulating foot portion frame. Releasing the first and second parts allows removal of the mattress.

In another embodiment, the first part of the two-part mechanical fastener is provided as a first part of a zipper running along the bottom of the mattress. The second part of the two-part mechanical fastener is a second part of the zipper running along one or more of the articulating head portion frame, articulating center portion frame and articulating foot portion frame. In one embodiment, the second part of the zipper is contained in a strip of fabric attached to one or more of the articulating head portion frame, articulating center portion frame and articulating foot portion frame. In another embodiment, the second part of the zipper is provided on a sheet of fabric that is placed under one or more of the articulating head portion frame, articulating center portion frame and articulating foot portion frame. Again, the mattress is placed on the top of the articulating head portion frame, articulating center portion frame and articulating foot portion frame, and the first and second parts of the zipper are aligned. The zipper is then closed, securing the mattress to the articulating head portion frame, articulating center portion frame and articulating foot portion frame.

In one embodiment, articulating bed member includes at least one mattress topper 178 attached to the top of the mattress and disposed on at least one of the articulating head portion, the articulating center portion and the articulating foot portion. In one embodiment, the articulating bed member includes a plurality of mattress toppers. Each mattress topper is attached to one of a plurality of mattresses. Suitable mattress toppers provide protection for the mattress or impart a soft cushion surface to the top of the surface. While the mattress topper can be fixed to the top of the mattress, for example using stitching, preferably the mattress topper is removably attached to the top of the mattress. In one embodiment, the mattress topper includes the first part of a two-part mechanical fastener, and the mattress includes a second part of the two-part mechanical fastener. Suitable two-part mechanical fasteners include, but are not limited to, a zipper, a hook and loop type fastener, a snap, a pin type fastener, a hook and eye type fastener, a button, a magnetic fastener, a buckle and strap, a clamp, a clasp and combinations thereof. In one embodiment, the mattress topper is secured to the mattress using a plurality of elastic straps.

In one embodiment, the articulating bed frame includes a rotating and pivoting frame 144. The rotating and pivoting frame is disposed in the cavity 180 and is mounted on the horizontal support surface 106. In one embodiment, the rotating and pivoting frame is positioned on or above a support plate 146 mounted to the horizontal support surface. In one embodiment, the rotating and pivoting frame is in communication with and attached to at least one of the articulating head portion and the articulating foot portion. In another embodiment, the rotating and pivoting frame is in communication with and connected to the articulating center portion. In one embodiment, connection to the articulating head portion, the articulating center portion or the articulating foot portion is connection to the articulating head portion frame, the articulating center portion frame or the articulating foot portion frame.

The rotating and pivoting frame 144 is rotatable with respect to the horizontal support surface or the support plate around a vertical axis 148 passing through and perpendicular to the horizontal support surface and the support plate. The rotating and pivoting frame also provides pivoting movement of the articulating bed member with respect to the horizontal support surface to tilt the articulating bed member toward at least one of the articulating head portion as indicated by arrow C, and the articulating foot portion as indicated by arrow D. In one embodiment, the rotating and pivoting frame pivots the articulating center portion or the articulating center portion frame backwards towards the articulating head portion or forward towards the articulating foot portion. In one embodiment, the rotating and pivoting frame is pivotally connected to the articulating center portion or the articulating center portion frame. In one embodiment, the rotating and pivoting frame is pivotally connected to the articulating center portion or the articulating center portion frame at one or more pivot points 170.

In one embodiment, the rotating and articulating bed includes a shaft 166 passing from the fixed bed frame through the support plate and into the rotating and pivoting frame. The shaft is a cylindrical shaft that is concentric with vertical axis. In one embodiment, the rotating and pivoting frame is rotatable around the vertical axis through an angle up to about 90° in a single direction of rotation around the vertical axis. In another embodiment, the rotating and pivoting frame is rotatable around the vertical axis in a first direction of rotation through an angle up to about 90° and in a second direction of rotation through an angle up to about 90°. The first direction of rotation is opposite the second direction of rotation. In one embodiment, the rotating and pivoting frame is rotatable around the vertical axis through an angle up to about 360°.

In one embodiment, the rotating and pivoting frame 144 includes a bearing plate 169 disposed on top of the support plate 146. A bearing surface is defined between the bearing plate and the support plate, and the bearing plate rotates with respect to the support plate on the bearing surface. In one embodiment, a plastic bearing member is included between the bearing plate and the support plate. In another embodiment, bearings, including ball bearing and roller bearings are provided between the bearing plate and the support plate, for example, in channels or grooves in the bearing surface, to improve rotation between the bearing plate and the support plate.

Figure 13:
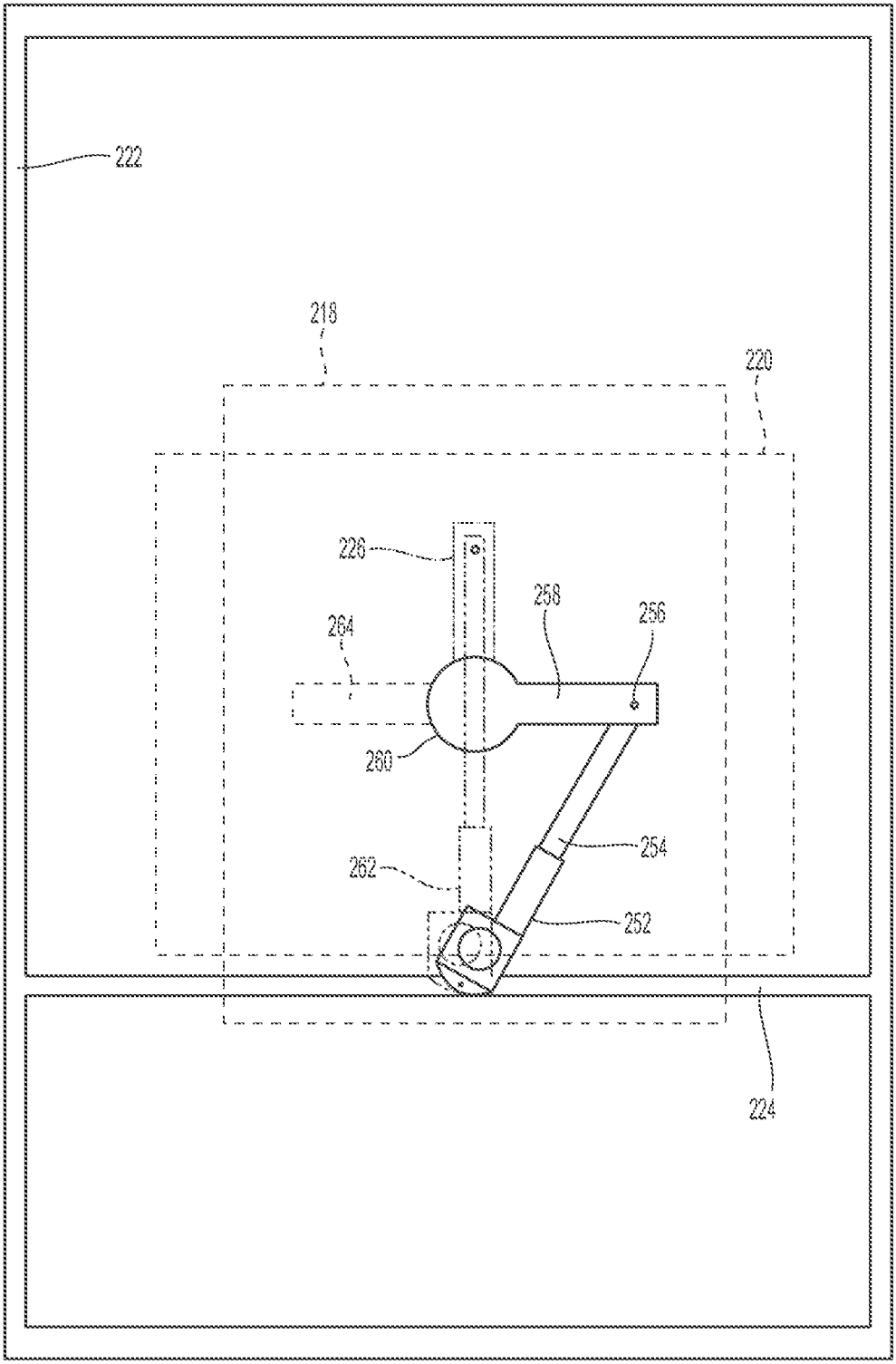
FIG. 13 is a schematic representation of a rotation actuator for rotating the shaft and bearing plate.

In one embodiment, the bearing plate is fixedly attached to the shaft 166 and does not rotate with respect to the shaft. Therefore, rotation of the shaft rotates the bearing plate. Referring now to FIG. 13, in one embodiment, the rotation actuator 252, i.e., the actuator that provides rotation of the bearing plate, is a linear actuator that is disposed within the fixed frame 222 and rotationally or pivotally connected to a frame member 224 within the fixed frame. The extensible rod 254 of the rotation actuator is connected to an arm 258 attached to and extending from the shaft 260 at a pivot point 256. The shaft is fixedly connected to the bearing plate. Therefore, when the rotation actuator is in a first position, e.g., retracted, the bearing plate is in a first non-rotated position 218. Extending the extensible rod moves the rotation actuator to a second position 262 and the arm to a second position 226. This also rotates the shaft and moves the bearing plates to a second rotated position 220, which represents 90° of rotation in a first direction. Rotation of the shaft and therefore the bearing plate through 90° degrees in a second direction opposite the first direction can be accomplished by having the arm in a reversed first position 264.

Returning to FIGS. 1-10, in another embodiment, a motor is provided in communication with one end of the shaft disposed in the rotating and pivoting frame. The motor is fixedly attached to the shaft and to the rotating and pivoting frame, e.g., the bearing plate. Therefore, the motor rotates the bearing plate and therefore the rotating and pivoting frame around the shaft. In another embodiment, a motor 164 is disposed in the fixed frame and is in contact with a portion of the shaft disposed in the fixed frame. The motor is fixedly attached to the fixed frame and to the shaft. In addition, the portion of the shaft extending into the rotating and pivoting frame is fixedly secured to the rotating and pivoting frame, i.e., the bearing plate. Therefore, the motor rotates the shaft around the vertical axis, and the rotating shaft rotates the rotating and pivoting frame around the vertical axis.

In one embodiment, the rotating and pivoting frame includes a pair of parallel frames members 182 spaced from each other and extending under the articulating center portion and articulating center portion frame. Each frame member includes a top 184, and the articulating center portion frame articulates with respect to each top from an initial position that is in contact with or adjacent and parallel to the tops to positions in which the articulating center portion frame is at an angle to each top. In one embodiment, each frame member is connected to the articulating center portion frame, for example at a pivot point. In one embodiment, the articulating center portion frame is attached to each frame member to provide both pivoting and sliding movement of the articulating center portion with respect to the rotating and pivoting frame.

In one embodiment, each parallel frame member is secured to the bearing plate, for example, by welds or using a plurality of fasteners such as bolts. In one embodiment, each frame member is attached to the bearing plate using three fasteners, one adjacent either end of the frame member and one in the middle of the frame member. Therefore, rotation of the bearing plate rotates the parallel frame members. The fasteners do not interfere with the rotation of the bearing plate with respect to the support plate. In one embodiment, a pivot actuator 168 is disposed on the bearing plate between the parallel frame members. Preferably, the pivot actuator is a linear actuator. The pivot actuator is disposed between and pivotally attached to the bearing plate and the articulating center portion frame. Movement of the pivot actuator, and in particular the push rod of the pivot actuator, produces pivoting movement of the articulating center portion. Therefore, the rotating and pivoting frame includes four actuators, a head portion actuator, a foot portion actuator, a rotation actuator and a pivot actuator. In one embodiment, all four actuators are linear actuators. In one embodiment, all four actuators are identical actuators.

Figure 14:
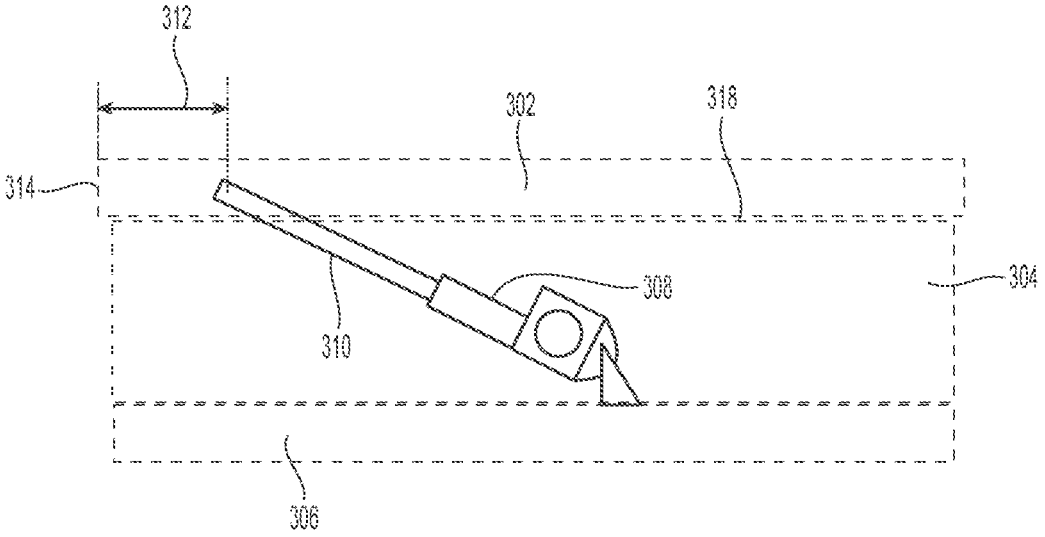
FIG. 14 is a schematic representation of a pivot actuator attached to the articulating center portion frame and with the articulating center portion frame in an initial flat position.
Figure 15:
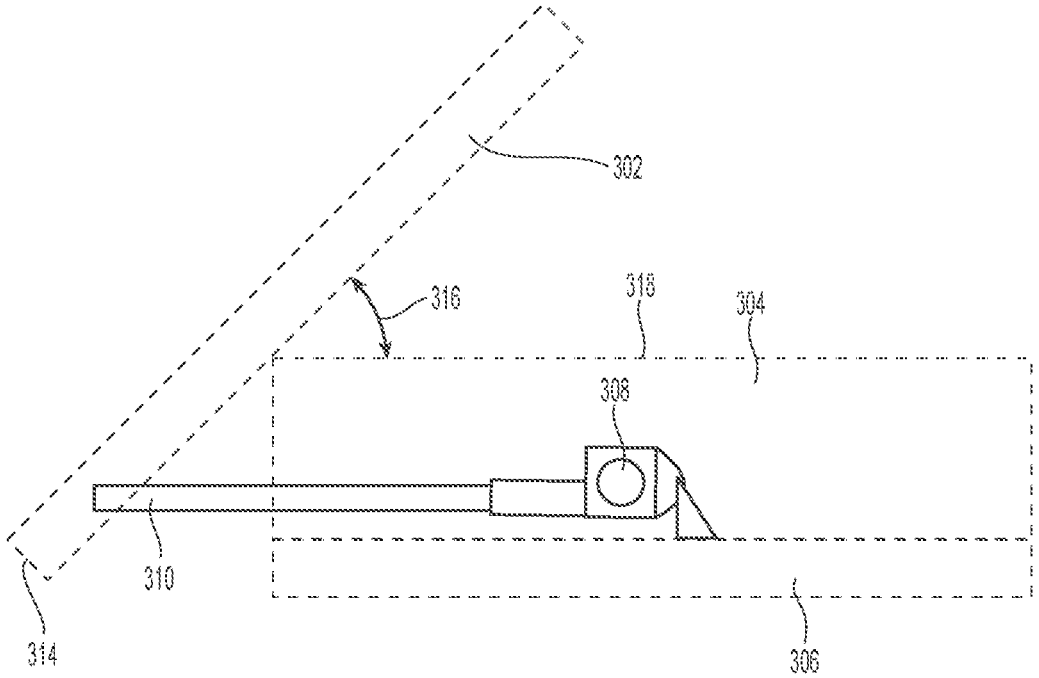
FIG. 15 is a schematic representation of a pivot actuator attached to the articulating center portion frame and with the articulating center portion frame pivoted toward the articulating foot portion.

Referring now to FIGS. 14 and 15, in one embodiment, the pivot actuator 308 is pivotally connected to the top of the bearing plate 306 between the parallel frame members 304. The end of extensible rod 310 of the pivot actuator is rotationally or pivotally connected to the articulating center portion frame 302. In one embodiment, the extensible rod is connected and spaced a distance 312 from the end 314 of the articulating center portion frame adjacent the articulating foot portions. In one embodiment, the distance is about 8 inches. When the pivot actuator is in a first retracted position, the articulating center portion frame 302 is substantially flat and located above and parallel to the top surfaces 318 of the parallel frame members (FIG. 14). Extending the extensible rod pivots the articulating center portion frame, and therefore, the articulating bed member, toward the foot end (FIG. 15). This lifts the articulating center portion frame off the top surfaces of the parallel frame members and defines an angle 316, i.e., the pivot angle, between the articulating center portion frame and the top surfaces. The pivot actuator also pivots downward toward the bearing plate. In addition, the end 314 of the articulating center portion frame drops below the plane of the top surfaces 318 of the parallel frame members and toward the horizontal support surface or floor. Retracting the pivot actuator returns the articulating center portion frame, and therefore, the articulating bed member, to the position illustrated in FIG. 14.

Returning to FIGS. 1-10, in one embodiment, the articulating center portion pivots independent of any sliding movement. For example, the rotating and pivoting frame member includes an actuator that pushes on the articulating center portion frame to pivot the articulating center portion around the pivot points. In addition, articulating bed member can slide with respect to the fixed bed frame either in a direction from side to side of the fixed bed frame as indicated by arrow E or in a direction from the head end to the foot end of the fixed bed frame as indicated by arrow by arrow F. The articulating bed member slides in a plane parallel to the plane of the horizontal support surface. In one embodiment, the rotating and pivoting frame member can slide with respect to the mounting plate and the articulating center portion frame. In another embodiment, the articulating center portion simultaneously slides and pivots with respect to the rotating and pivoting frame.

The rotating and articulating bed includes a control assembly 164. Preferably, the control assembly is located in the fixed bed frame. The control assembly is in communication with the motors and actuators of the rotating and articulating bed to provide for the desired adjustments and operation of the rotating and articulating bed. The control assembly includes, but is not limited to, control electronics, computers, programmable logic controllers, power supplies, batteries and wireless communication systems. In one embodiment, the rotating and articulating bed includes at least one remote control 190 in communication with the control assembly. Suitable remote controls include wireless and wired controllers. The remote control provides for articulating, pivoting and sliding movement of the rotating and articulating bed.

Figure 3:
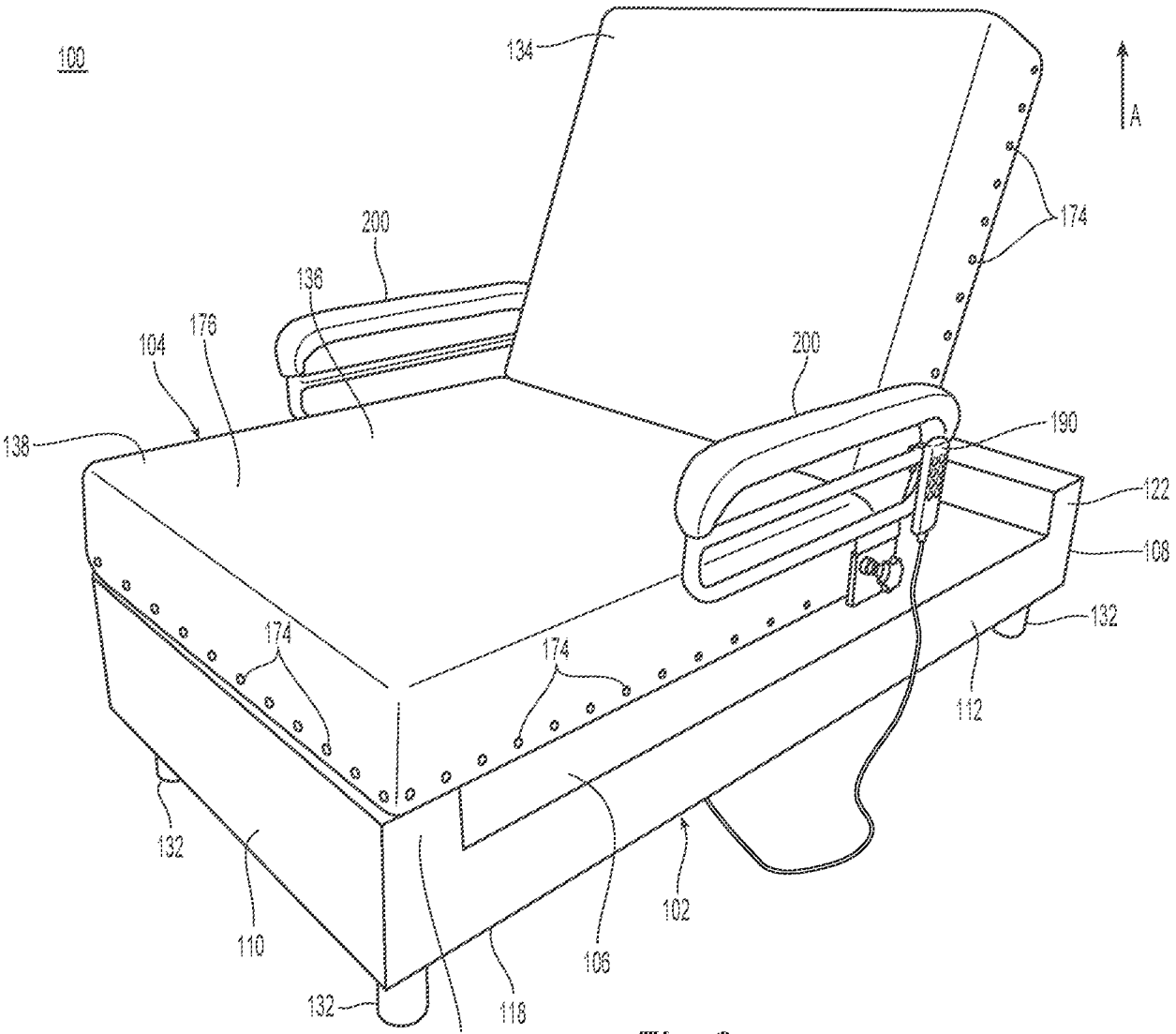
FIG. 3 is a is a top perspective view of an embodiment of a rotating and articulating bed with the articulating head portion raised.
Figure 4:
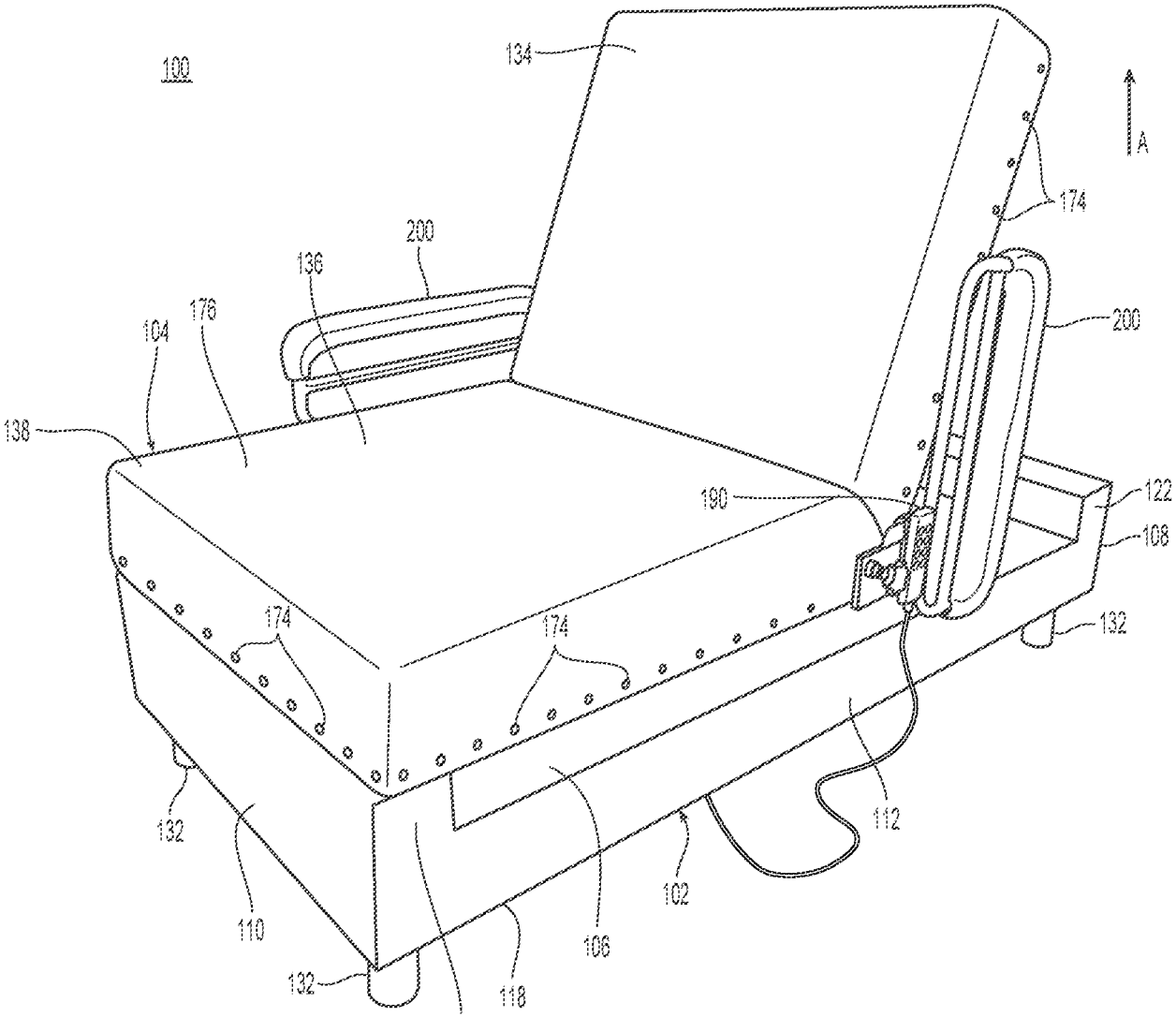
FIG. 4 is a is a top perspective view of an embodiment of a rotating and articulating bed with the articulating head portion raised and an arm assembly raised.

The rotating and articulating bed further includes a pair of arm assemblies 200. Each arm assembly is attached to one of the opposing sides of the articulating bed member. Preferably, each arm assembly is connected to an opposing side of the articulating center portion and in particular the articulating center portion frame. Each arm assembly can be positioned in a first lowered position with the one or more of the articulating head portion, articulating center portion and articulating foot portion in either a flat arrangement (FIG. 1) or an articulated arrangement (FIG. 3). Each arm assembly can be positioned in a second raised position with the one or more of the articulating head portion, articulating center portion and articulating foot portion in either a flat arrangement (FIG. 2) or an articulated arrangement (FIG. 4).

Figure 11:
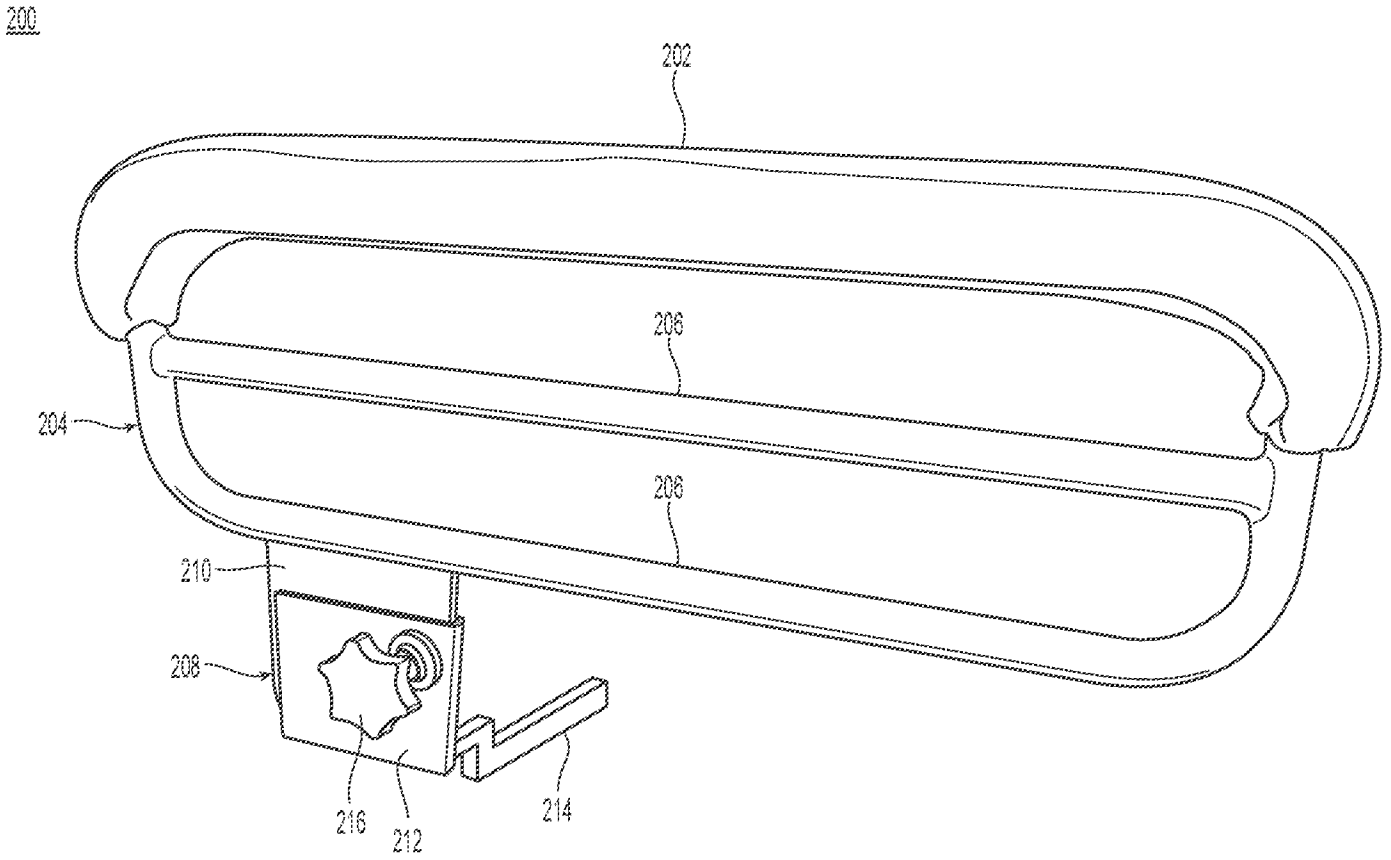
FIG. 11 is a perspective view of an embodiment of an arm assembly.
Figure 12:
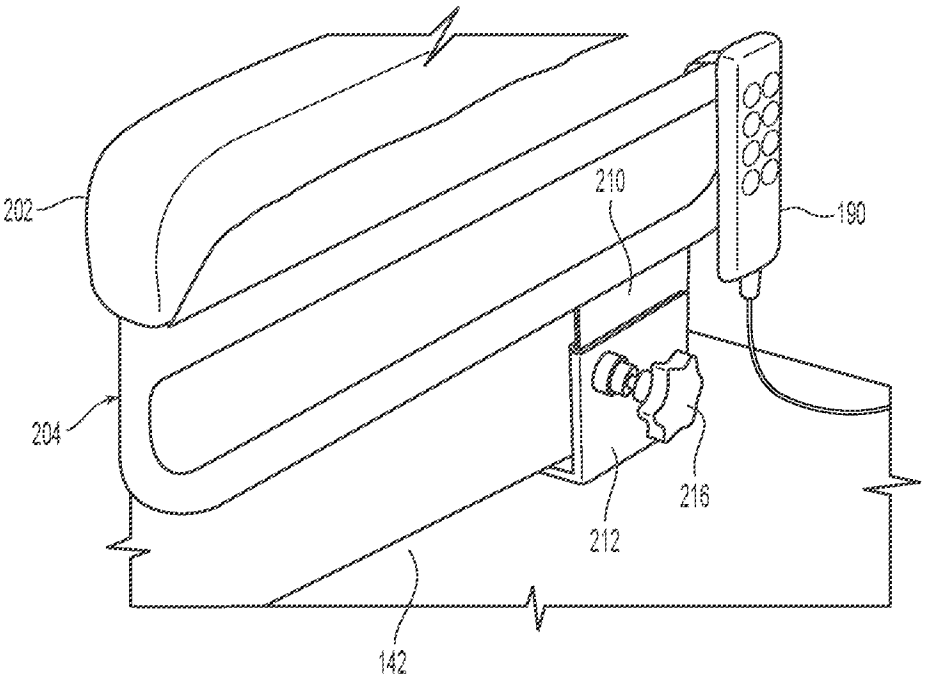
FIG. 12 is a partial view of an embodiment of an arm assembly attached to a bottom surface of an articulating center portion of the rotating and articulating bed.

Referring now to FIGS. 11 and 12, each arm assembly includes an arm assembly frame 204 having a plurality of parallel horizontal frame members 206. Suitable materials for the assembly frame include tubular metals. A padded cover 202 is attached to the top horizontal frame member. An attachment frame 208 is connected to the arm assembly frame. The attachment frame includes a flange 210 attached or welded to the bottom horizontal frame member. A mounting plate 212 is pivotally connected to the flange 210. A mounting arm 214 extends from the mounting plate. The mounting arm includes a bend or extends downward from the mounting plate to connect the arm assembly to the bottom surface 142 (FIG. 10) of the articulating center portion and in particular the articulating center portion frame. In one embodiment, the mounting arm and therefore the attachment frame is removably attached to the articulating center portion. The mounting plate pivotally connected to the flange, providing a pivot point between the arm assembly frame and the attachment frame such that the arm assembly frame is rotatable respect to the attachment frame and in particular the mounting plate around the pivot point. In one embodiment, each arm assembly and in particular each attachment frame includes a locking mechanism 212 disposed between the flange of the arm assembly frame and the mounting plate of the attachment frame to prevent rotation of the arm assembly with respect to the attachment frame. Suitable locking mechanisms include set screws and spring-loaded pins. In one embodiment, the arm assembly is removably connected to the attachment frame.

In one embodiment, the different portions of the rotating and articulating bed can be dissembled for shipping and storage. Therefore, one or more of the fixed bed frame, legs, rotating and picoting frame, articulating head portion frame, articulating center portion frame, articulating foot portion frame, mattress, mattress topper, arm assembly and control assembly are constructed as separate assemblies. These separate assemblies are then assembled into the rotating and articulating bed.

The rotating and pivoting frame of the rotating and articulating bed provides pivoting movement of the articulating bed member with respect to the horizontal support surface to tilt the articulating bed member toward the articulating foot portion from a first position with the articulating foot portion located above the horizontal support surface to a second position with the articulating foot portion extending below the horizontal support surface. The horizontal support surface is located at a given height above the floor, and the articulating foot portion extends below the horizontal support surface a distance greater than or equal to the given height when the articulating bed member is in the second position. Therefore, the articulating foot portion extends at the way to the floor. In one embodiment, rotating and pivoting frame provides lateral movement of the articulating bed member along a plane parallel to and spaced from the horizontal support surface to move the articulating bed member toward the articulating head portion or the articulating foot portion.

Figure 5:
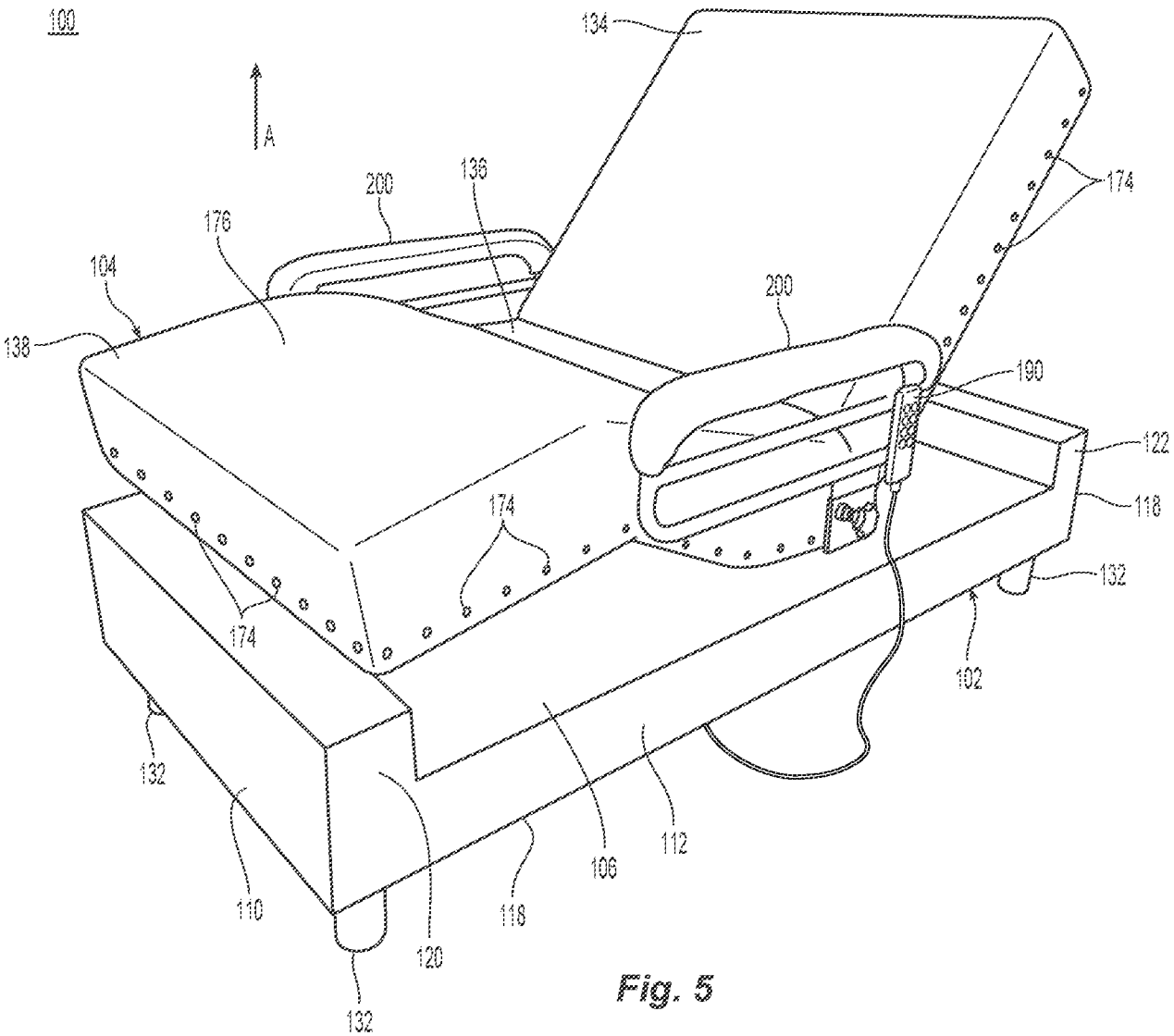
FIG. 5 is a is a top perspective view of an embodiment of a rotating and articulating bed with the articulating head portion raised and the articulating foot portion raised.

The articulating bed member can be positioned with the articulating head portion, the articulating center portion and the articulating foot portion flat and parallel to the horizontal support surface (FIG. 1). The arm assemblies can be down to provide side support rails or raised (FIG. 2) to facilitate entry into the rotating and articulating bed frame. From this flat position, with the articulating head portion, the articulating center portion and the articulating foot portion aligned with the head end and foot end of the fixed bed frame, the rotating and articulating bed is operated as an articulating bed to raise and lower the articulating head portion (FIG. 3) or the articulating head portion, the articulating center portion and the articulating foot portion (FIG. 5). The arm assemblies can also be raised when one or more of the articulating head portion, the articulating center portion and the articulating foot portion are articulated (FIG. 4) to provide movement into and out of the rotating and articulating bed in the articulated position.

Figure 6:
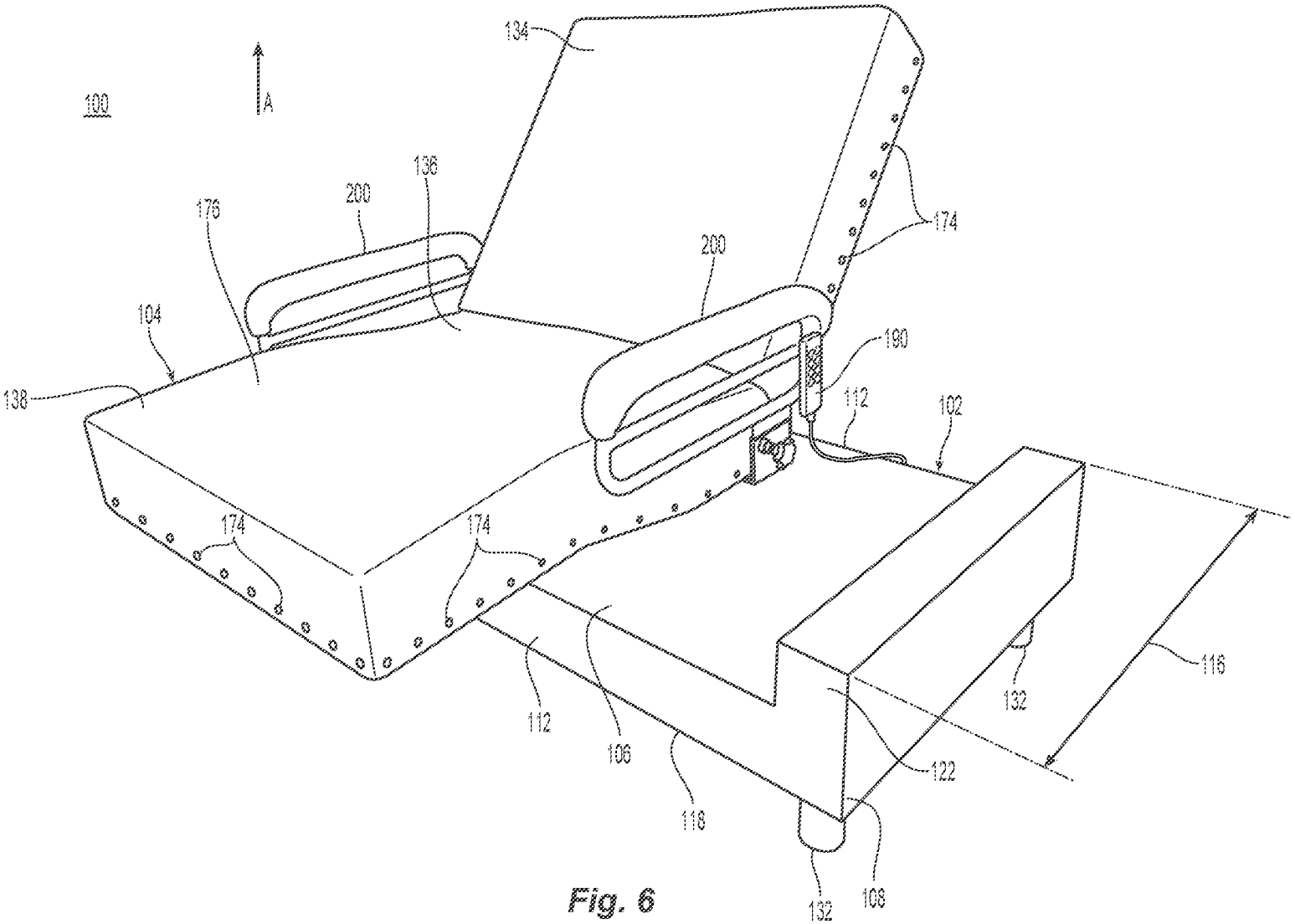
FIG. 6 is a top perspective view of an embodiment of a rotating and articulating bed with the articulating head portion raised, the articulating foot portion raised and the articulating bed member rotated 90°.
Figure 7:
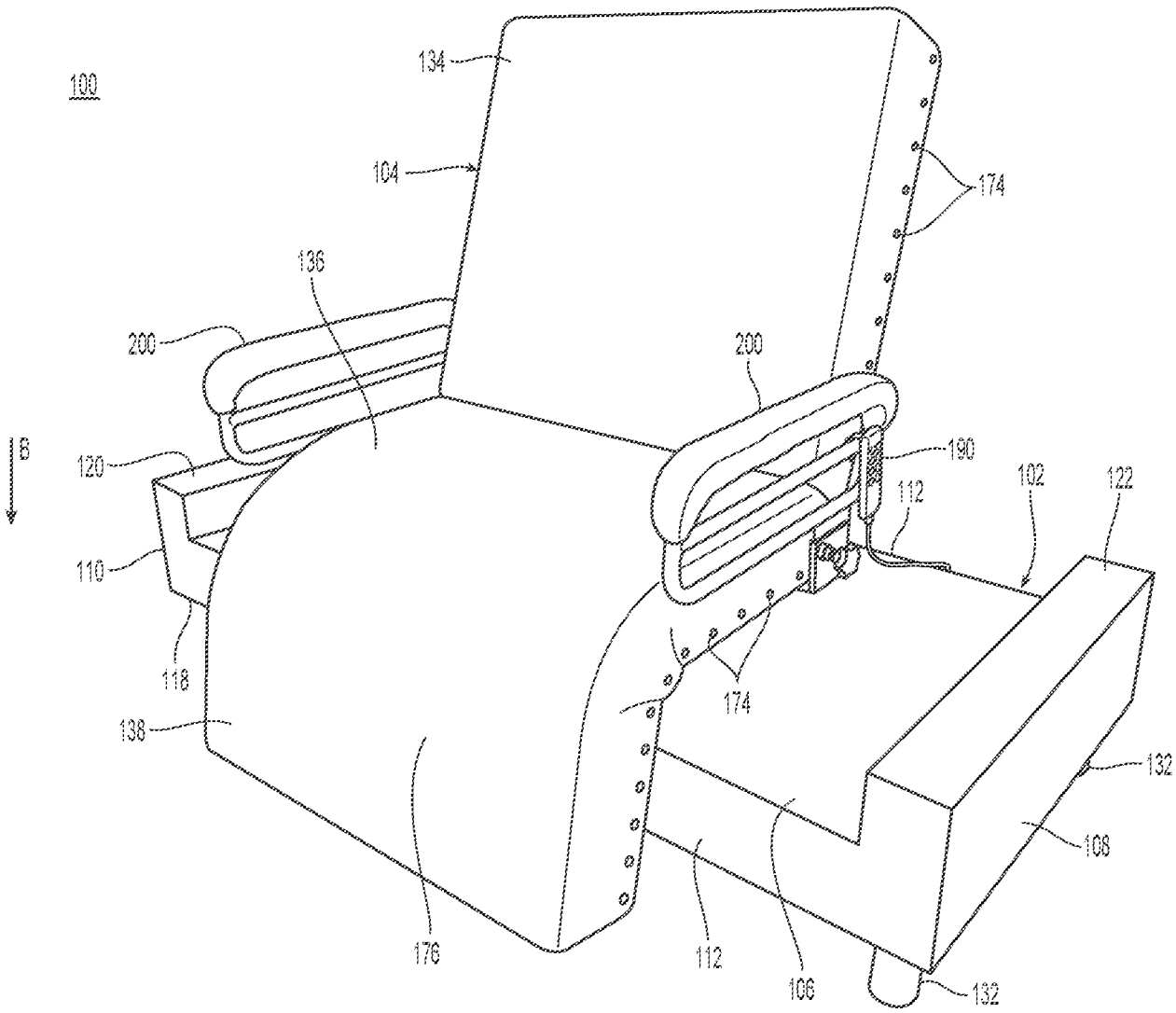
FIG. 7 is a top perspective view of an embodiment of a rotating and articulating bed with the articulating head portion raised, the articulating bed member rotated 90° and the articulating foot portion lowered past the plane of the horizontal support surface.
Figure 8:
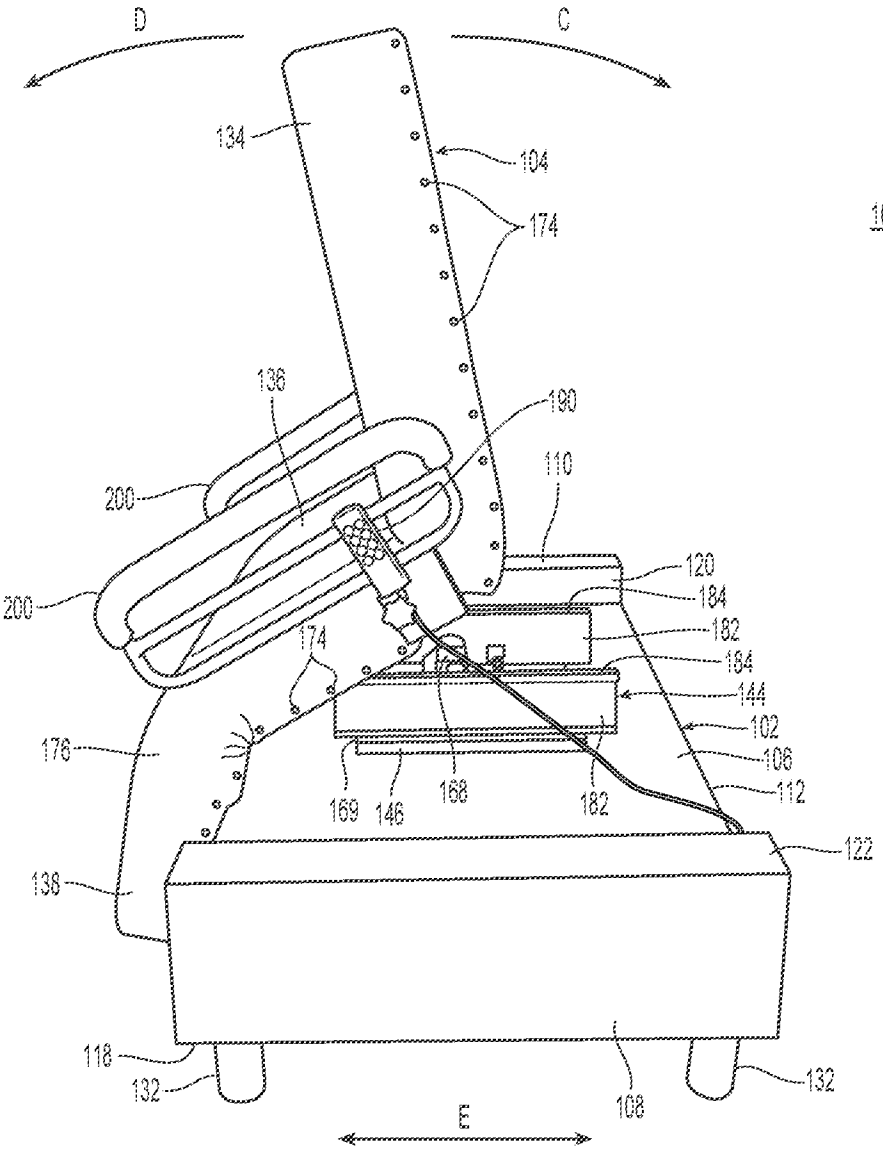
FIG. 8 is a top perspective view from a head end of an embodiment of a rotating and articulating bed with the articulating head portion raised, the articulating bed member rotated 90°, the articulating foot portion lowered past the plane of the horizontal support surface and the articulating bed member pivoted toward the articulating foot portion.
Figure 9:
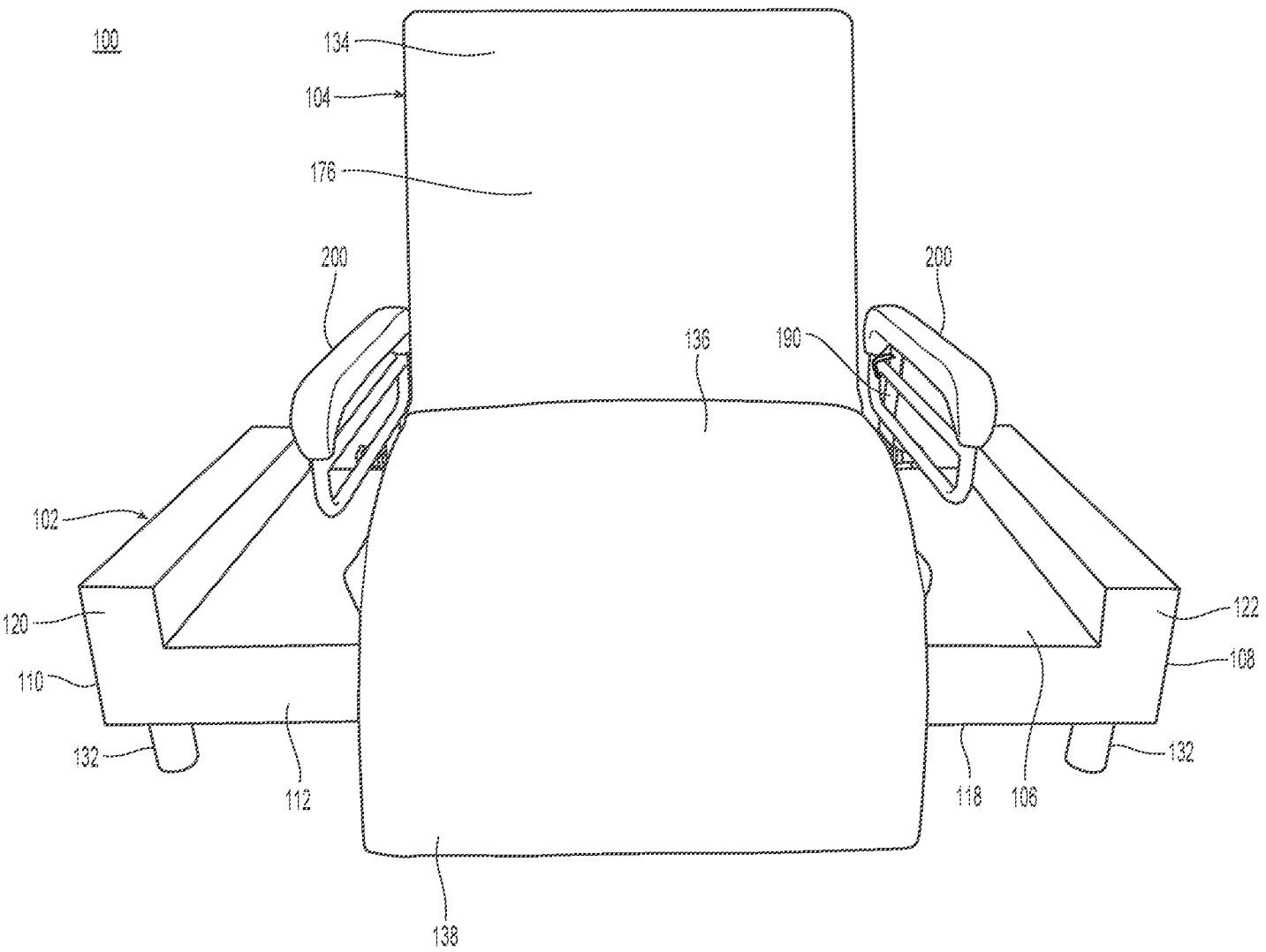
FIG. 9 is a top perspective view from a side of an embodiment of a rotating and articulating bed with the articulating head portion raised, the articulating bed member rotated 90°, the articulating foot portion lowered past the plane of the horizontal support surface and the articulating bed member pivoted toward the articulating foot portion until the articulating foot portion contacts the floor.
Figure 10:
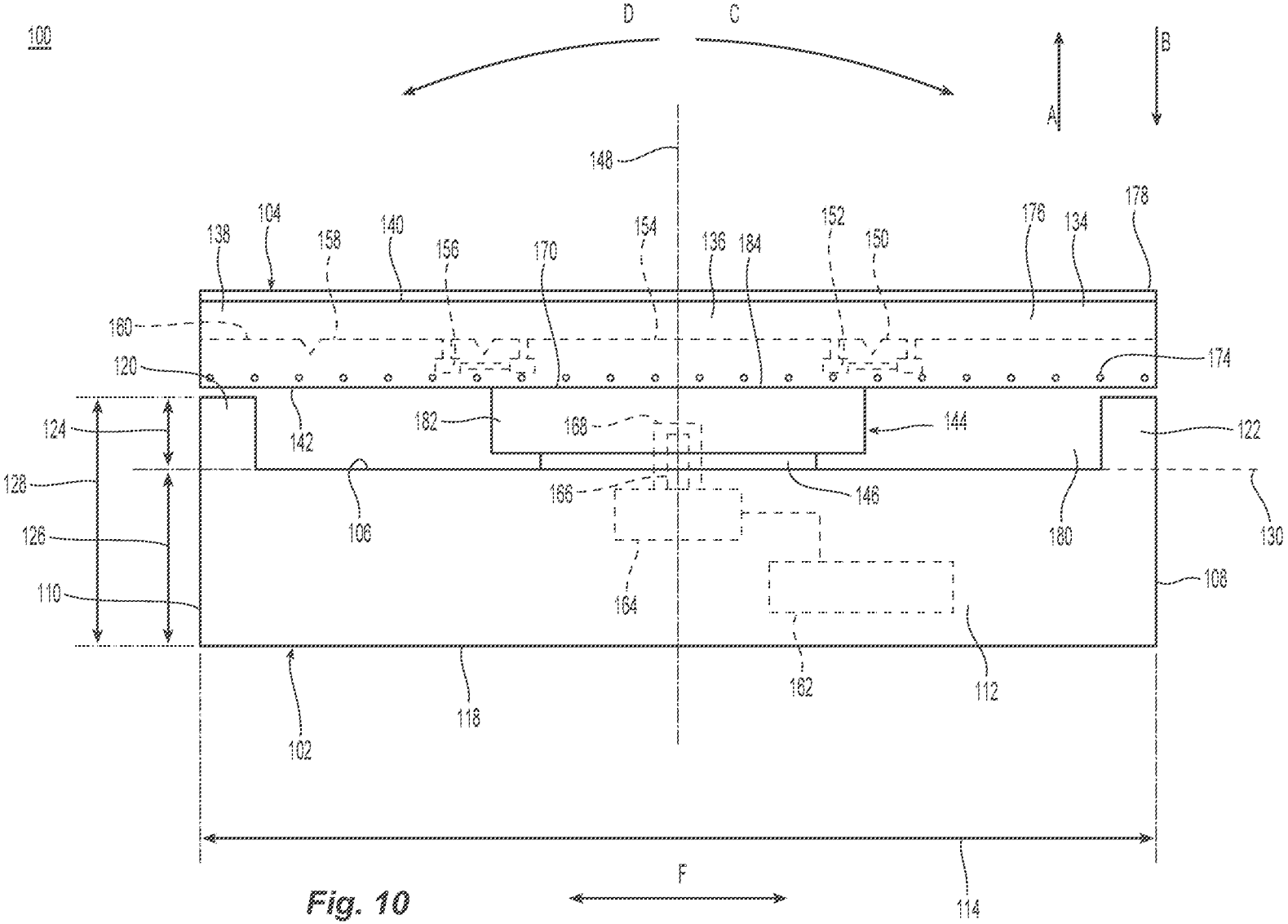
FIG. 10 is a schematic elevational representation of an embodiment of a rotating and articulating bed.

With the articulating head portion, the articulating center portion and the articulating foot portion in either a flat position or an articulated position, the articulating bed member is rotated with respect to the horizontal support surface (FIG. 6). The articulating bed member is rotated through an angle of 90°. The articulating head portion is raised, and the articulating foot portion, which may have been initially raised, is lowered. The articulating foot portion is lowered past the plane of the horizontal support surface (FIG. 7). The articulating bed member is then pivoted or tilted, and in one embodiment pivoted and slid, toward to articulating foot portion and over the side of the fixed bed frame (FIG. 8). In one embodiment, the articulating center portion is pivoted or pivoted and slid with respect to the rotating and pivoting frame. Pivoting and pivoting and sliding movement continues until the articulating foot portion contacts the floor (FIG. 9). As the articulating center portion pivots with respect to the rotating and pivoting frame, the articulating bed member not only positions the occupant toward the side of the rotating and articulating bed in a seated position, but also lifts the occupant to a standing position, as the back of the articulating center portion adjacent the articulating head portion lifts the hips and lower back of the occupant and the articulating head portion tilts forward. Therefore, a person of limited mobility can get out of bed. Reversing these steps allows the person with limited mobility to get into bed and to utilize the articulating features of the rotating and articulating bed.

Although the features and elements of the present exemplary embodiments are described in the embodiments in particular combinations, each feature or element can be used alone without the other features and elements of the embodiments or in various combinations with or without other features and elements disclosed herein. Any methods or flowcharts provided in the present application may be implemented in a computer program, software, or firmware tangibly embodied in a computer-readable storage medium for execution by a dedicated computer or a processor.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A rotating and articulating bed comprising:

a fixed bed frame comprising a horizontal support surface; and an articulating bed member comprising:

an articulating head portion;

an articulating foot portion separate from the articulating head portion; and a rotating and pivoting frame mounted on the horizontal support surface and in communication with the articulating head portion and the articulating foot portion, the rotating and pivoting frame rotatable with respect to the horizontal support surface around a vertical axis passing through the horizontal support surface and providing pivoting and sliding movement of the articulating head portion and the articulating foot portion with respect to the horizontal support surface to tilt and to provide lateral movement in at least one of the articulating head portion and the articulating foot portion with respect to the horizontal support surface of the fixed bed frame.

2. The rotating and articulating bed of claim 1, wherein the articulating head portion and articulating foot portion each articulate with respect to each other downward toward the horizontal support surface and upward away from the horizontal support surface, independent of rotation of the rotating and pivoting frame and of pivoting and sliding movement with respect to the horizontal support surface.

3. The rotating and articulating bed of claim 2, wherein the articulating foot portion articulates downward past a plane containing the horizontal support surface.

4. The rotating and articulating bed of claim 1, wherein:

the articulating bed member further comprises an articulating center portion disposed between the articulating head portion and the articulating foot portion; and the articulating head portion and the articulating foot portion articulate with respect to the articulating center portion independent of rotation of the rotating and pivoting frame and of pivoting and sliding movement with respect to the horizontal support surface.

5. The rotating and articulating bed of claim 1, wherein:

the articulating bed member further comprises an articulating center portion disposed between the articulating head portion and the articulating foot portion; and the rotating and pivoting frame is connected to the articulating center to achieve pivoting and sliding movement of the articulating center portion with respect to the horizontal support surface.

6. The rotating and articulating bed of claim 1, wherein the rotating and pivoting frame provides pivoting and sliding movement of the articulating center portion with respect to the horizontal support surface to tilt the articulating bed member toward the articulating foot portion from a first position with the articulating foot portion located above the horizontal support surface to a second position with the articulating foot portion extending below the horizontal support surface.

7. The rotating and articulating bed of claim 6, wherein:

the horizontal support surface is located at a given height; and the articulating foot portion extends below the horizontal support surface a distance greater than or equal to the given height when the articulating bed member is in the second position.

8. The rotating and articulating bed of claim 1, wherein the rotating and pivoting frame is rotatable around the vertical axis through an angle up to about 90°.

9. The rotating and articulating bed of claim 1, wherein the rotating and pivoting frame is rotatable around the vertical axis in a first direction of rotation through an angle up to about 90° and in a second direction of rotation through an angle up to about 90°, the first direction of rotation opposite the second direction of rotation.

10. The rotating and articulating bed of claim 1, wherein the rotating and pivoting frame is rotatable around the vertical axis through an angle up to about 360°.

11. The rotating and articulating bed of claim 1, wherein:

the articulating bed member further comprises:

an articulating center portion disposed between the articulating head portion and the articulating foot portion, the articulating center portion comprising a top surface and a bottom surface opposite the top surface; and a pair of opposing sides extending from the articulating head portion, through the articulating center portion to the articulating foot portion; and the rotating and articulating bed further comprises a pair of arm assemblies, each arm assembly attached to one of the opposing sides and comprising:

an attachment frame connected to the bottom surface of the articulating center portion; and an arm connected to the attachment frame at a pivot point and rotatable with respect to the attachment frame around the pivot point.

12. The rotating and articulating bed of claim 11, wherein each arm assembly further comprises a locking mechanism disposed between the arm and the attachment frame to prevent rotation of the arm with respect to the attachment frame.

13. The rotating and articulating bed of claim 11, wherein the attachment frame is removably connected to the bottom surface of the articulating center portion or the arm is removably connected to the attachment frame.

14. The rotating and articulating bed of claim 1, wherein the articulating bed member further comprises:

an articulating head portion frame;

an articulating foot portion frame;

an articulating center portion disposed between the articulating head portion the articulating foot portion and comprising an articulating center portion frame; and at least one mattress removably attached to the articulating head portion frame, articulating center portion frame and articulating foot portion frame.

15. The rotating and articulating bed of claim 14, wherein the articulating bed member further comprises a plurality of mattresses, each mattress removably attached to one of the articulating head portion frame, articulating center portion frame and articulating foot portion frame.

16. The rotating and articulating bed of claim 14, wherein the mattress comprises at least one first part of a two-part mechanical fastener and at least one of the articulating head portion frame, articulating center portion frame and articulating foot portion frame comprises at least one second part of the two-part mechanical fastener.

17. The rotating and articulating bed of claim 16, wherein the two-part mechanical fastener comprises a zipper, a hook and loop type fastener, a snap, a pin type fastener, a hook and eye type fastener, a button, a magnetic fastener, a buckle and strap, a clamp, a clasp or combinations thereof.

18. The rotating and articulating bed of claim 1, wherein the articulating bed member further comprises:

a mattress disposed on at least one of the articulating head portion and the articulating foot portion; and a mattress topper removably attached to the mattress.

19. The rotating and articulating bed of claim 1, wherein the articulating bed member further comprises:

an articulating center portion disposed between the articulating head portion and the articulating foot portion; and a pivot actuator disposed between the rotating and pivoting frame and the articulating center portion to provides pivoting and lateral movement of the articulating head portion, the articulating center portion and the articulating foot portion with respect to the horizontal support surface.

20. A rotating and articulating bed comprising:

a fixed bed frame comprising a horizontal support surface; and an articulating bed member comprising:

an articulating head portion comprising an articulating head portion frame;

an articulating foot portion separate from the articulating head portion and comprising an articulating foot portion frame;

an articulating center portion disposed between the articulating head portion and the articulating foot portion and comprising an articulating center portion frame, the articulating head portion and articulating foot portion each articulate with respect to the articulating center portion downward toward the horizontal support surface and upward away from the horizontal support surface;

a rotating and pivoting frame mounted on the horizontal support surface and connected to the articulating center portion, the rotating and pivoting frame rotatable with respect to the horizontal support surface around a vertical axis passing through the horizontal support surface and providing pivoting and sliding movement of the articulating center portion with respect to the horizontal support surface to tilt and to provide lateral movement in at least one of the articulating head portion, the articulating center portion and the articulating foot portion with the respect to the horizontal support surface of the fixed bed frame; and at least one mattress removably attached to the articulating head portion frame, articulating center portion frame and articulating foot portion frame.

* * * * *